United States Patent [19]

Lynch, Jr. et al.

[11] Patent Number: 4,641,801

[45] Date of Patent: Feb. 10, 1987

[54] TERMINALLY GUIDED WEAPON DELIVERY SYSTEM

[76] Inventors: David D. Lynch, Jr., 18651 Gledhill St., Northridge, Calif. 91324; William H. Bell, c/o Federal Corrections Institution, Springfield, Mo. 65802

[21] Appl. No.: 821,865

[22] Filed: Jan. 22, 1986 (Under 37 CFR 1.47)

Related U.S. Application Data

[63] Continuation of Ser. No. 755,533, Jul. 15, 1985, abandoned, which is a continuation of Ser. No. 371,636, Apr. 21, 1982, abandoned.

[51] Int. Cl.[4] ..... F41G 7/30

[52] U.S. Cl. ..... 244/3.14; 244/3.11; 244/3.22

[58] Field of Search ..... 244/3.11, 3.14, 3.19, 244/3.22

[56] References Cited

U.S. PATENT DOCUMENTS

| | | | |
|---|---|---|---|
| 3,028,807 | 4/1962 | Burton et al. | 244/3.13 |
| 3,141,635 | 7/1964 | Davis et al. | 244/3.14 |
| 3,168,264 | 2/1965 | Sendles | 244/3.14 |
| 3,374,967 | 3/1968 | Plumley | 244/3.22 |
| 3,714,898 | 2/1973 | Ziemba | 244/3.14 |
| 3,758,052 | 9/1973 | McAlexander et al. | 244/3.22 |
| 3,860,199 | 1/1975 | Dunne | 244/3.13 |
| 4,219,170 | 8/1980 | Esker | 244/3.14 |
| 4,347,996 | 9/1982 | Grosso | 244/3.22 |

*Primary Examiner*—Charles T. Jordan

*Attorney, Agent, or Firm*—Leonard A. Alkov; A. W. Karambelas

[57] ABSTRACT

A command guidance weapon system comprising a radar target tracking system, and a weapon with small thrusters mounted on the periphery thereof and with a small beacon transmitter which is tracked by a ground-based fire control system is disclosed. A rapid terminal maneuver is executed by the weapon at an appropriate point in the trajectory of the weapon by sequentially firing the small thrusters. The angular orientation of the weapon is obtained by canting a polarized antenna, located on the rear of the weapon, with respect to the longitudinal axis of the weapon so that the signal transmitted from the weapon to the ground-based fire control system is modulated. The fire control system computes the precise time, based upon the angular orientation of the weapon and the distance between the weapon and the target, to initiate the terminal maneuver by the weapon, and sends a command signal to the weapon.

1 Claim, 10 Drawing Figures

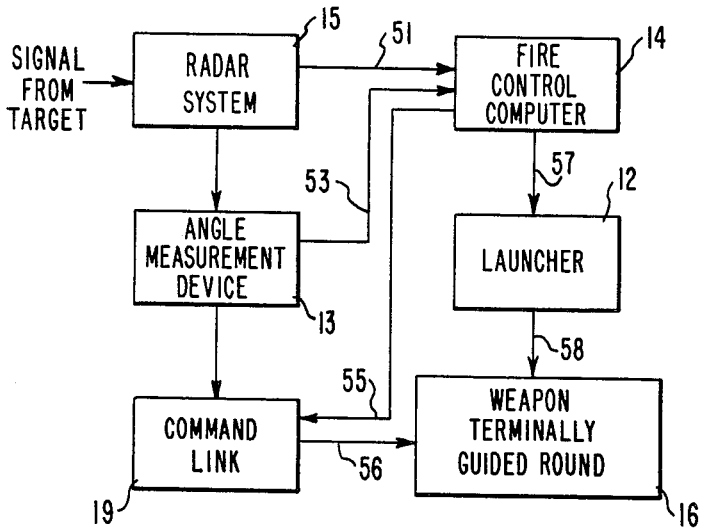
Fig. 2.
Fig. 6.
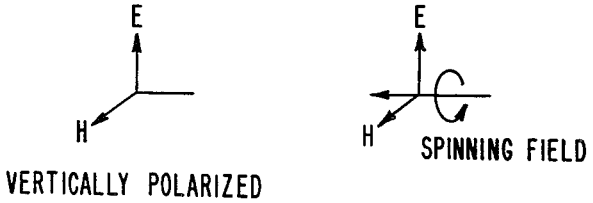
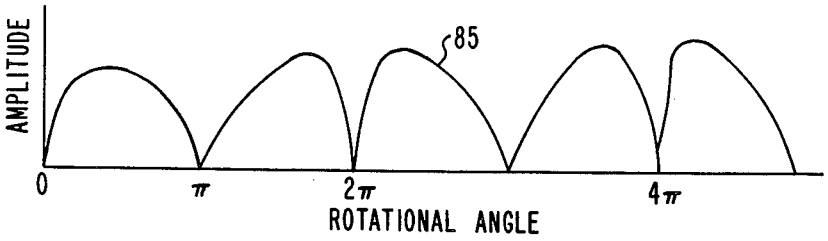
Fig. 8.

TERMINALLY GUIDED WEAPON DELIVERY SYSTEM

This application is a continuation of application Ser. No. 755,533, filed July 15, 1985, now abandoned, which was a continuation of application Ser. No. 371,636, filed Apr. 21, 1982, now abandoned.

BACKGROUND OF THE INVENTION

1. Field of the Invention

This invention relates to weapon systems, and more specifically to weapon systems which track maneuvering targets and launch terminally guided projectiles toward targets.

2. Description of the Prior Art

One type of weapon system which is intended to destroy enemy ground-based or airborne targets uses as weapons unguided projectiles or missiles against targets with relatively low target acceleration capability. Other systems have been developed which require a means for tracking the target, a means for tracking a projectile or missile initially aimed at the target, and a means for reducing or eliminating the miss vector between the target and the projectile or missile. The means for reducing or eliminating the miss vector provides guidance to the projectile or missile so that the projectile or missile will proceed to either hit the target directly or explode in such close vicinity to the target lethal zone so as to fatally damage the target. Most anti-airborne and anti-ground based target weapon systems provide continuous projectile or missile trajectory correction whereby information is sent to the projectile or missile at some predesignated data rate, so as to alter the course of the projectile or missile, and energy resources of the projectile are used throughout the course of the flight of the projectile or missile, or for some relatively lengthy terminal phase of the flight of the projectile, to maneuver the projectile or missile to within the lethal zone at the end of the flight of the projectile or missile. Furthermore, when a missile is used, guidance and control systems on board the missile are often actively employed in obtaining information about the target and/or computing corrections to its own flight path. Such guidance and control systems on board the missile greatly increase the cost of designing, manufacturing, testing, and maintaining the missile. Although the weapon guidance technique hereinbefore described has been demonstrated to be effective against relatively slowly accelerating targets, serious difficulties have arisen in attempting to eliminate targets which can rapidly accelerate as the weapon enters its terminal phase of the trajectory. When the weapon has been directed throughout its entire flight to the predicted location of the target, and uses most of its energy resources therefor, a rapid maneuver by a target, wherein the target severely deviates from its expected flight path, near the end of the flight of the weapon, cannot generally be compensated, since system delay times prevent the system from responding to rapid changes and sufficient energy resources to maneuver the weapon are no longer available to correct for extreme changes in the miss vector during the terminal phase of the flight of the weapon.

Modern weapon systems having purposes similar to the invention herein disclosed have been investigated and designed in the past two decades. A gun-fired missile system concept commonly referred to as POLCAT, was investigated by the Bulova Research and Development Laboratories. The POLCAT concept of weapon delivery employs a gun-launched anti-tank weapon with terminal trajectory correction using a semiactive guidance technique and impulse control. The POLCAT weapon system concept employs a frame-fixed target seeker for guidance and a single-impulse applied at the center of gravity normal to the longitudinal axis of the weapon for trajectory correction. The system operates by firing a missile, in a manner similar to that of a conventional gun system, when a target is engaged. In one version of POLCAT, an illuminator in the missile transmits pulsed radiation with a narrow radiation beam throughout the flight, which is required because ground targets, in general, do not have sufficiently intense or discrete signature. Correction of the missile trajectory is initiated when a line-of-sight control angle is determined which indicates an increasing miss of the target. By this technique, near misses are controlled close to the target and larger deviations are controlled further from the target, because a threshold angle for trajectory control is a constant value. The missile incorporates a forward-looking receiver that determines the pertinent angles to the target, so as to provide data to alter the trajectory of the missile.

The DRAGON missile system is a light-weight system designed to be carried by a foot soldier and fired against tanks or other targets within an approximate range of 1,000 meters, and intended for use as a medium anti-tank missile at the infantry platoon level. The system consists of a cylindrical missile, a portable launcher for firing the missile, a sighting means or "tracker" for visually following the missile in flight after launch, and appropriate electronic means for correcting the flight path of the missile during the flight from the launcher to the target. The missile is fired from a tubular launcher after the launcher is aimed at the designated target. The missile is required to be of a proper aerodynamic configuration and must rotate about its longitudinal axis in flight to maintain flight stability. The rotation, as well as aerodynamic stability of the missile, is provided by fins located in the aft area of the periphery of the missile. Guidance of the missile during flight is provided in the following manner. When the missile is launched, the soldier who fired the weapon sights the missile through an optical viewer throughout its flight to the target. The course of the missile is automatically corrected in flight by keeping the view of the missile as near as possible to the cross hairs of the optical viewer through which the soldier sights the missile and computing the deviation of the missile from its course to the target. The system is designed to keep the missile on a direct line-of-sight to the target, rather than having a fixed trajectory from the point of launch to a correction point near the target. The missile is kept on course by discharging (by explosion or detonation) small "thrusters" or jets which are built into the periphery of the missile from front to rear and discharged at an angle to the longitudinal axis of the missile. The timing and direction of application of the thrusters determine the direction of motion of the missile throughout the flight of the missile. The thrusters are fired electronically in the following manner. A light source is mounted in the tail of the missile. The beam of light from the light source impinges on an optical detector in the tracker component which senses whether the missile is above, below, to the right, or to the left of the line-of-sight from the tracker to the target. Depending upon the quadrant of the detector upon which the beam impinges, a signal is sent over a wire to the missile to fire one or more of the thrusters at a designated time and in a designated sequence so as to correct for deviations of the missile from the line-of-sight. The wire over which the signal is transmitted is wound on a spool, which is mounted on the rear of the missile, and the wire feeds out as the missile moves toward the target and maintains the connection between the tracker and the missile throughout the flight of the missile. The cost goal of the weapon round is $2,000–$2,500 and for the tracker of the missile is $8,000–$10,000, according to *Aviation Week & Space Technology,* "Program Slip Delays Export of Dragons," Feb. 3, 1975.

SUMMARY OF THE INVENTION

The advantage of the present weapon system invention in relation to prior art ground-based or airborne weapon systems is the ability to provide highly accurate performance against maneuvering airborne or ground targets with the use of a relatively inexpensive artillery launched round, for example. The need for an expensive weapon and the control thereof through the entire course of flight of the weapon is eliminated. Furthermore, the miss vector between the weapon and the target is determined as a function of predetermined ballistic-trajectory computations and the position of the target is determined by radar tracking of the target. Moreover, the miss vector is reduced during the terminal stage of flight of the weapon by sending a single signal to the weapon to fire thrusters located on the periphery of the weapon. The angular orientation of the weapon, with respect to the longitudinal axis of the weapon, governs the timing and sequence of the firing of the thrusters so as to force the weapon toward the target. The angular orientation of the weapon is determined from the transmission of beacon signals from the rear of the weapon via a polarized antenna which is canted by a few degrees with respect to the longitudinal axis of the weapon. A one-time correction signal is sent from a ground-based fire control system causing thrusters located on the periphery of the weapon to rapidly detonate in a particular sequence, so as to force the weapon to destroy the target by exploding within a lethal zone surrounding the target. The timing of the correction signal is based upon an estimated position of the weapon (as computed from ballistics), an estimate of the angular orientation of the weapon (as derived from signals transmitted from a canted antenna located at the rear of the weapon), and an estimate of the position of the target at the end of the trajectory of the weapon (as derived from radar tracking).

In keeping with the principles of the present invention, the purposes are accomplished with the unique combination of a fire control system with a radar target tracking system, and a weapon having small thrusters mounted on the periphery thereof and with a small beacon transmitter which is tracked by the ground-based radar system. At the appropriate point in the trajectory of the weapon, a terminal maneuver is executed by the weapon by sequentially firing small thrusters located around the periphery at the center of gravity of the weapon.

Accordingly, it is a general purpose of the present invention to provide an improved weapon delivery system.

Another purpose of the invention is to provide a target weapon system which uses a relatively inexpensive weapon.

A further purpose of the invention is to provide weapon system having day-night and zero visibility conditions (including fog, smoke, and haze), all-weather capability.

Still another purpose of the invention is to provide an improved anti-airborne or anti-ground target weapon delivery system.

BRIEF DESCRIPTION OF THE DRAWINGS

The following specification and the accompanying drawings describe and illustrate an embodiment of the present invention. A complete understanding of the invention, including the novel features and purpose thereof, will be provided by consideration of the specification and drawings.

FIG. 2 is a schematic block diagram of the weapon delivery system depicting the elements of the invention;

FIG. 6 depicts the respective antenna fields of the antenna associated with the fire control system and the antenna associated with the weapon;

FIG. 8 depicts the modulation of the beacon signal sent from the weapon to the ground-based radar, wherein the antenna on the weapon is canted by a few degrees relative to the longitudinal axis of the weapon;

DETAILED DESCRIPTION OF THE INVENTION

1. General Description of the Weapon System

Figure 1:
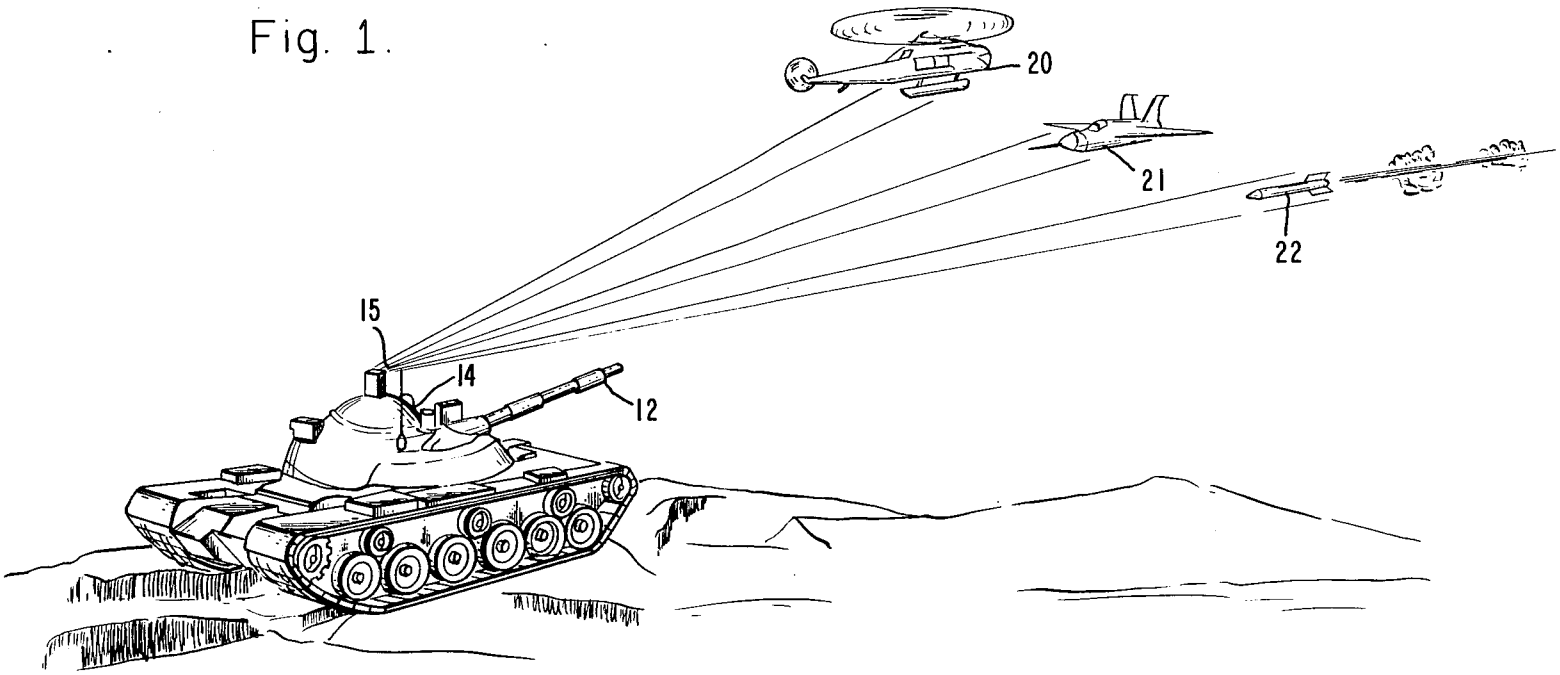
FIG. 1 illustrates typical battlefield encounters wherein the weapon system is employed, depicting a tank with a ground-based fire control system (including a radar system), a weapon, and three kinds of airborne targets.

The use of the present invention is depicted in FIG. 1. FIG. 1 illustrates fire control system 11 with radar system 15 of the weapon system mounted on tank 10. Tank 10 is located on a typical battlefield. Launcher 12 is a part of tank 10 and is used to launch the weapon associated with the invention. As a part of fire control system 11, radar system 15 is shown to be tracking, by way of antenna tracking beam 17, various enemy airborne targets. FIG. 1 depicts helicopter 20 as such a target; low flying jet aircraft 21 as such a target; and missile 22 as such a target. Although only airborne targets are shown, the weapon system has the capability of eliminating ground targets with the use of a suitable radar system 15 and weapon 16.

FIG. 1 also pictorially illustrates the capability of radar system 15 to track multiple targets. Radar system 15 is shown to be simultaneously tracking the hereinbefore described targets, viz., helicopter 20, low flying jet aircraft 21, and missile 22.

2. Elements of the Weapon System

FIG. 2 is a schematic block diagram of the weapon delivery system of the invention including the weapon, depicting the elements of the invention and the interactions thereof, as indicated by data interfaces 51 to 58. FIG. 2 used in conjunction with FIG. 3 describes the weapon system of the present invention.

2(a) Radar System

Radar system 15 is a conventional tracking radar used to locate, acquire, and track airborne targets, such as the U.S. Roland II, the APG 63 radar system used on the F-15 military aircraft or the APG 65 radar system used on the F/A-18 military aircraft; an advanced artillary round tracking radar such as the TPQ 36 or TPQ 37 can also be used. Radar system 15 is used to evaluate the range, relative velocity, and angular position of the weapon. It should be noted that any sensor which accurately measures range can be used, such as a laser, as well as a conventional microwave radar. On data interface 51, the following data is transferred from radar system 15 to fire control computer 14: the position of target 21, in terms of the range and line-of-sight angle from radar system 15 to target 21; the velocity of target 21 relative to radar system 15; the acceleration of target 21 in the direction of the line-of-sight from radar system 15 to target 21; the acceleration of target 21 in the direction normal to the line-of-sight; and the angular rate of the line-of-sight to target 21. Radar system 15 also has a data interface 52 to weapon attitude angle measurement device 13. An appropriate radar system may be used to track maneuvering ground targets, when so required.

2(b) Fire Control Computer

Fire control computer 14 calculates significant quantities for fire control system 11 based upon information from radar data system 15 and attitude angle measurment device 13. Fire control computer 14 receives data input on data interface 51 from radar system 15 and on data interface 53 from measurement device 13. Fire control computer 14 determines the direction in which launcher 12 should be pointed for weapon 16 to be launched without terminal correction to intercept target 21, assuming that target 21 continues on its trajectory 32 without making a terminal maneuver, and computes the lead angle for launcher ballistics. After weapon 16 has been launched, fire control computer 14 continues to predict the future position of weapon 16 and compare this predicted position to the predicted target position information by using the data obtained from radar system 15. As previously explained, if target 21 maneuvers so that weapon 16 cannot expect to intercept the target, weapon 16 will maneuver upon the receipt of a command signal causing weapon 16 to intercept target 21 to within a lethal zone surounding target 21. The time $t_c$ for commanding the initiation of the maneuver depends upon the miss vector $\bar{e}$, the roll angle of the longitudinal axis of weapon 16 and the roll rate about the longitudinal axis of weapon 16, which are determined by fire control computer 14. At the precise time $t_c$ that the maneuver is required by weapon 16, a command signal is initiated on data interface 55 from fire control computer 14 to command link 19, whereby the signal is transmitted to weapon 16, as indicated by data interface 56.

2(c) Measuring Device

Figure 9:
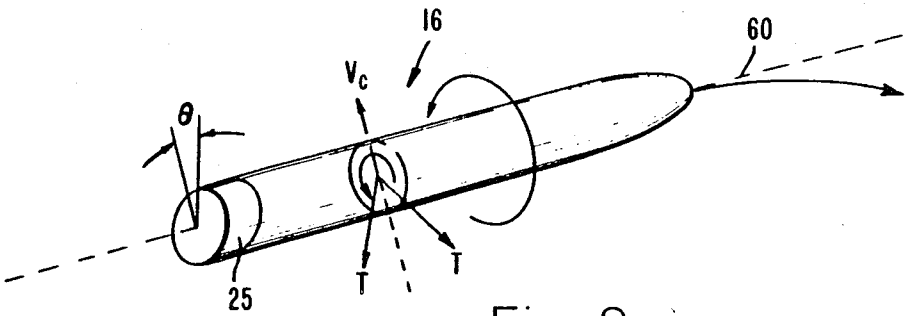
FIG. 9 further illustrates the air defense weapon delivery concept by depicting the weapon, having forces acting thereon by thusters located on the periphery of the weapon, with the antenna located at the rear thereof and the canted orientation of the antenna with respect to the longitudinal axis of the weapon.

Measurement device 13 employs a unique use of a conventional scanning tracking system, such as those conventional scanning tracking systems which are used on radar tracking systems. Measurement device 13 has a receiver used to monitor weapon 16 spin attitude. In conjunction therewith, measurement device 13 has a highly polarized antenna which receives a signal sent from antenna 25 located at the rear of weapon 16 (as depicted in FIG. 9) and directed in the vicinity of tank 10. The signal indicates the relative rotational orientation about the longitudinal axis of weapon 16, which is further explained infra with reference to FIGS. 6 and 9. Measurement device 13 also supplies command link 19 with a local oscillator (LO) reference signal, as indicated by data inteface 54.

2(d) Launcher

Launcher 12 generally consists of a slaveable gimbaled gun mounted on tank 10. Information to correctly position launcher 12 is provided from fire control computer 14 on data interface 57. The information so provided consists of the commanded angle information to position launcher 12 and any aiding information that is necesary to drive launcher 12 at the large angular rates which may be necessary. Weapon 16 is fired in the direction in which launcher 12 is pointing which is so indicated as data interface 58.

2(e) Command Link

Command link 19 transmits the one-time command signal to weapon 16. Command link 19 obtains the information from fire control computer 14 on data interface 55. The information on data interface 55 consists of the one-time command to fire the initial thruster on the periphery of weapon 16 and the time interval for firing the subsequent thrusters. Command link 19 transmits this information on data and interface 56 to weapon 16 in coded form.

2(f) Weapon

Weapon 16 is a terminally guided artillery round. Weapon 16 is similar to any other air defense round with the exception that high explosive side thrusters are located on the periphery around the center of gravity and weapon 16 contains a receiver and logic system to detonate the thrusters to impart a single, fixed magnitude lateral velocity upon command from fire control system 11 via command link 19. Weapon 16 is fired from the smooth bore of launcher 12 using a plastic carrier called a sabot. The plastic carrier is separated from weapon 16 immediately after it leaves launcher 12 by wind force. Weapon 16 also has fins located on the periphery of the weapon in order to induce spin, by canting the fins with respect to the longitudinal axis of weapon 16, after it leaves launcher 12, in a conventional design. Spinning weapon 16 provides a more stable ballistic trajectory than a conventional artillery round. Weapon 16 also has a proximity fuse and a blast fragmentation type warhead, which is detonated by the proximity fuse. This combination allows a high probability of hitting the target without actually intercepting the target. Explosive thrusters on the periphery of weapon 16 provide the means for the rapid maneuver of weapon 16 at the terminal phase of the flight to eliminate target 21. The maneuver of weapon 16 occurs in response to the command signal from command link 19 when weapon 16 has the correct angular orientation. This command signal could be mechanized by a special modulation added to the tracking radar radiation. The explosive thrusters are detonated in a predetermined sequence as weapon 16 spins so as to impute a fixed lateral velocity ($V_c$) to weapon 16. Weapon 16 further has a command link receiver and an intervalometer which will fire the initial thruster of weapon 16 on command and the subsequent thrusters at a commanded interval. Weapon 16 has a radio frequency (RF) diplexer in order to permit it to transmit and receive signals simultaneously on different signal frequencies.

3. Weapon Delivery Concept

The weapon delivery concept of the present invention is described with reference to FIGS. 3, 4, 5, and 9.

Figure 3:
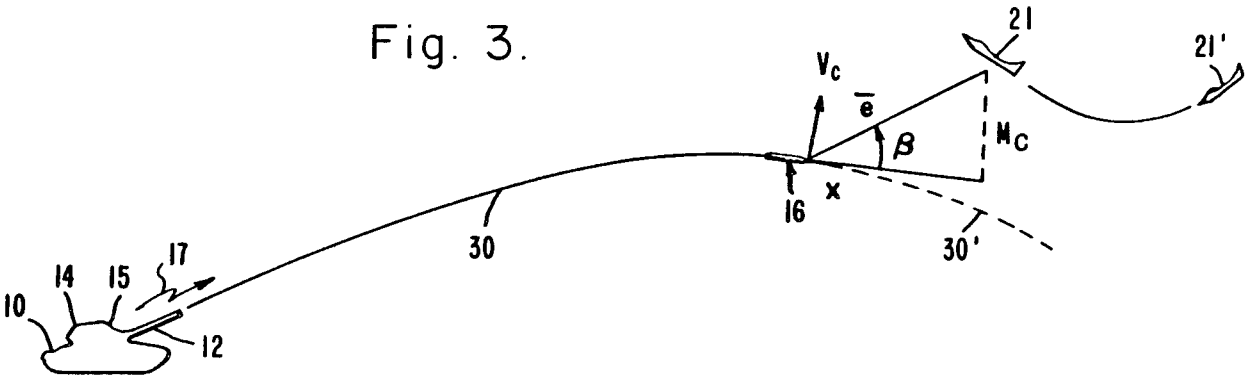
FIG. 3 is a diagram which illustrates the air defense weapon delivery concept involved with the invention indicating the flight path of the weapon and the airborne target.

FIG. 3 pictorially illustrates in general the weapon delivery concept involved with the invention. Radar system 15 associated with fire control system 14 is shown mounted on tank 10. Radar system 15 is tracking target 21 with antenna tracking beam 17. Target 21 is traversing flight path 32. Target 21' represents target 21 at another location on flight path 32. Weapon 16 has been launched from launcher 12 and is traversing flight path 30. An error vector $\bar{e}$ is the magnitude of the distance between weapon 16 and target 21 and the relative orientation of said distance, as indicated by angle $\beta$, at any instant in time. This distance is determined from the combination of radar measurement of the location of target 21 and ballistic prediction calculations of the location of weapon 16.

The vehicle used to carry launcher 12 and radar system 15 is depicted as tank 10.

Tank 10 is one of a variety of existing state-of-the-art military tanks. Examples thereof are the M48 tank, the M60 tank, and the M1 Main Battle Tank, which are used by the U.S. Army.

FIG. 3 also depicts the kinematics of weapon 16 for one point on trajectory 30 of weapon 16.

$V_L$ is the velocity vector of weapon 16 due to accelerations induced by forces acting on weapon 16 as it flies on trajectory 30; such forces include the initial firing velocity from launcher 12, drag on the weapon, wind, and gravity acting on the weapon.

$V_c$ is the correction velocity vector when initiated. Operationally, the guidance of weapon 16 involved with the weapon delivery concept is explained in further detail with reference to FIGS. 3, 4 and 5. Weapon 16 traverses flight path 30 having a rotational rate about its longitudinal axis of between 50 revolutions per second (r.p.s.), and 1000 r.p.s., but typically 100 r.p.s. A beacon signal is transmitted by weapon 16 using antenna 25 located at the rear of weapon 16 (as depicted in FIG. 9) and directed toward radar system 15. Antenna 25 is mounted at the rear of weapon 16 so as to be canted by 2 to 3 degrees with respect to the longitudinal axis of weapon 16. The beacon transmitted signal is used to indicate the relative angular orientation of weapon 16. The beacon signal also could be used to track the projectile to thereby improve the accuracy of the weapon system. In order for the control signal which is sent from weapon control system 11 to weapon 16 to properly initiate the rapid firing sequence of the thrusters located on the periphery of weapon 16, knowledge of the actual angular orientation of weapon 16 when the firing sequence of the thrusters is initiated is crucial in order for weapon 16 to eliminate target 21. Terminal flight path correction to reduce error vector $\bar{e}$, wherein weapon 16 rapidly accelerates so as to direct the velocity in the direction of target 21, is employed so as to take into account any large maneuvers produced by high accelerations by target 21, which may occcur any time after launching weapon 16 and before sending the control signal from fire control system 11 to weapon 16. The direction of the velocity vector is controlled by synchronizing the command signal with the spin attitude of weapon 16, and $t_c$ is so computed.

3(a) Computation of $t_c$

In general, the computation of the $t_c$ involves computing the time when the thrusters on the periphery of weapon 16 are to be detonated,which occurs when the product of the lateral correction velocity ($V_c$) and $t_c$ equals the miss distance ($M_c$), which is the direct linear distance between weapon 16 and target 21. The command time $t_c$ is delayed by a vernier amount until weapon 16 is at the proper spin attitude to point the lateral velocity at the proper angle, as determined by fire control computer 14. Thus from miss distance $M_c$, as derived from error vector $\bar{e}$, $t_c$, which is the optimum time to detonate the thrusters located on weapon 16, is computed to be equal to the computed miss distance ($M_c$) divided by the correction velocity ($V_c$). A time delay is included to account for computational processing.

FIG. 3 illustrates the nature of the error vector $\bar{e}$ at the time $t_c$ when the command signal has been received by weapon 16. Error vector $\bar{e}$ is shown to have a miss component $M_c$ and an angle $\beta$, both measured from a local plane which includes weapon 16. Target aircraft 21 is shown to be executing a high-acceleration, rapid maneuver, producing trajectory 32, just prior to $t_c$. The timing of the sending of the control signal from fire control system 11 to weapon 16 also depends upon the value of the magnitude of vector e is the magnitude of error vector $\bar{e}$. Error vector $\bar{e}$ is computed at any instant in time while weapon 16 is flying on trajectory 30 from the position coordinates of target 21 and weapon 16. The position of target 21 is estimated from measurements made by radar system 15 which uses radar search, acquisition and tracking techniques well known in radar art to locate and track the position of target 21. The position of weapon 16 is estimated by using ballistics tables and calculations well known in the art, as documented in the U.S. Navy report, *A Ballistic Trajectory Algorithm for Digital Airborne Fire Control* (A.A. Duke, T.H. Brown, K.W. Burke, R.B. Seeley), NWC Technical Publication 5416, Sept. 1972, based upon the nature of the weapon used; the initial angular orientation of the longitudinal axis of the launch; the initial velocity of the weapon; the air density; and local wind.

In particular, the computational requirements for $t_c$ can be demonstrated mathematically, first by defining the following relevant quantities:

$$\text{Error vector, } \bar{e}(t) = \begin{bmatrix} x_e \\ y_e \\ z_e \end{bmatrix}$$

-continued $$\text{Weapon position vector, } \overline{W}(t) = \begin{bmatrix} x_w \\ y_w \\ z_w \end{bmatrix}$$

$$\text{Target position vector, } \overline{T}(t) = \begin{bmatrix} x_T \\ y_T \\ z_T \end{bmatrix}$$

$$\text{Weapon velocity vector, } \overline{V}_w(t) = \begin{bmatrix} v_{xw} \\ 0 \\ v_{zw} - gt \end{bmatrix}$$

$$\text{Target velocity vector, } \overline{V}_T(t) = \begin{bmatrix} v_{xT} \\ v_{yT} \\ v_{zT} \end{bmatrix}$$

$$\text{Correction velocity vector, } V_c(t) = \begin{bmatrix} 0 \\ v_{yc} \cos \omega_w t_c \\ v_{zc} \sin \omega_w t_c \end{bmatrix}$$

K, kill radius of warhead associated with weapon 16, which is associated with the zone around the target, in three dimensions, wherein when the weapon warhead explodes, it is in such close vicinity of the target that the target is rendered fatally damaged;

$\omega_w$, angular rotational (or spin) rate of weapon 16;

g, constant of gravitational acceleration;

t, time.

Then, for the error vector $$\overline{T} = \overline{W} + \overline{e},$$

or $$\overline{e} = \overline{T} - \overline{W}.$$

From knowing that $$\overline{W} = \int_0^t \overline{V}_w dt + \int_0^t \overline{V}_c(t, t_c) dt,$$

it follows that $$\overline{e} = \int_0^t \overline{V}_t(t) dt - \int_0^t \overline{V}_w(t) dt - \int_0^t \overline{V}_c(t, t_c) dt.$$

Substituting, and integrating as above indicated, $$\begin{bmatrix} x_e \\ y_e \\ z_e \end{bmatrix} = \begin{bmatrix} v_{xT} \\ v_{yT} \\ v_{zT} \end{bmatrix} t - \begin{bmatrix} 0 \\ v_{yc} \cos \omega_w t_c \\ v_{zc} \sin \omega_w t_c \end{bmatrix} t - \begin{bmatrix} v_{xT} t \\ 0 \\ v_{zT} t - \frac{dt^2}{2} \end{bmatrix}$$

Therefore, $$, x_e = v_{xT} t - v_{xw} t \; ps$$
$$, y_e = v_{yT} t - (t - t_c) \; v_{yc} \cos \omega_w t_c$$

$$z_e = v_{zT} t - (t - t_c) \; v_{zc} \sin \omega_w t_c - v_{zw} t + \frac{gt^2}{2}$$

Or alternatively, $$\overline{e}(t) = \overline{V}_T t - \overline{V}_c t - \overline{W}(t)$$

It is required that $$|\overline{e}(t)| \leqq K.$$

for $t_c$.

At time $t_c$, upon receipt of the command signal by weapon 16, the thrusters located on the periphery of weapon 16 are fired in rapid predetermined sequence so as to decrease the magnitude of error vector $\overline{e}$ and intercept or come within a lethal zone of target 21. The firing sequence of the thrusters around the periphery of weapon 16 is performed in a predetermined order, so that the only control variables contributing to the accuracy of the hit are the angular orientation and firing rate of the thrusters of weapon 16 at the time the control signal is sent from fire control system 11 to weapon 16. Generally, the firing sequence of the thrusters is initiated when weapon 16 is within approximately the last second of flight on trajectory 30, and typically when weapon 16 is within the last one-half second of flight.

3.(b) Weapon Flight Path/Trajectory Alteration

Figure 4:
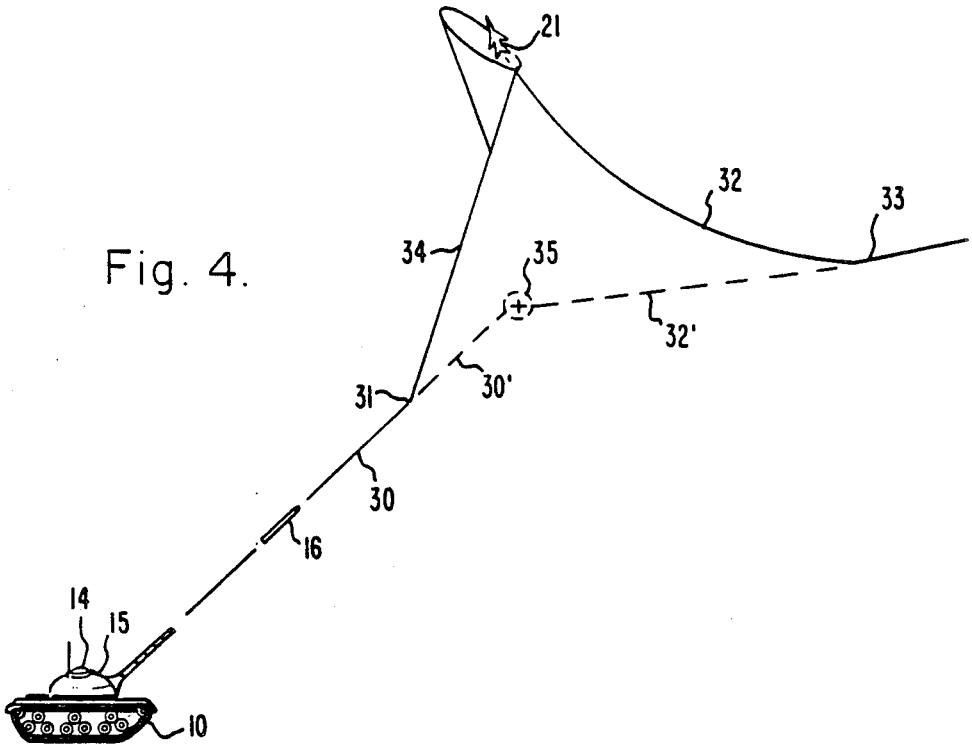
FIG. 4 depicts a typical change in flight paths of a target and a weapon to demonstrate the guidance concept of the weapon system.

FIG. 4 depicts the alteration in flight path 30 of weapon 16 resulting from the capability of fire control system 11 to track, using radar system 15, a rapid acceleration maneuver by target 21 on flight path 32. Fire control system 11 using radar system 15 is thereby capable of predicting the change in the flight path of target 21 to flight path 32 from flight path 32', which would have been the flight path of target 21 had target 21 not produced a rapid acceleration maneuver at point 33 on its flight path. Subsequent to target 21 altering its flight path at point 33, fire control system 11 sends a command signal to weapon 16 at time $t_c$ so as to detonate the thrusters located at the periphery of weapon 16 in a predesignated order, causing flight path 30 of weapon 16 to be altered to flight path 34 at point 31 on the flight path of weapon 16. Time $t_c$ is calculated so as to represent the time when the predicted position of target 21 intersects the line which represents the locus of all positions reachable by weapon 16 after the thrusters on the periphery of weapon 16 are fired. Cone 39 represents the lethal zone of the weapon warhead. Flight paths 30 and 30' depict the flight path of weapon 16 as predicted from ballistic computations by weapon control system 11. The ballistic computations predict a point of impact 35 of weapon 16 with target 21, assuming no variation in flight path 32' of target 21. The weapon system guidance using the thrusters on the periphery of weapon 16 permit weapon 16 to rapidly alter its flight path 30 to flight path 34 and thereby, within approximately one second, but typically one-half second, from the receipt of the command signal, come to within a lethal zone indicated by cone 39 of the target 21.

3(c) Force Thrusters

Figure 5:
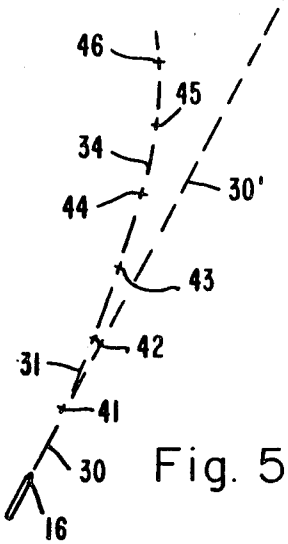
FIG. 5 depicts in further detail the change in flight path of the weapon as a result of thrusters acting on the weapon;.

FIG. 5 pictorially illustrates how the thrusters located at the periphery of weapon 16 are fired in sequence, thereby exerting forces on weapon 16 so as to alter the flight path of weapon 16 from flight path 30 to flight path 34, at point 31, deviating from flight path 30' which is a predicted flight path based on ballistic computations. Thusters located on the periphery of weapon 16 are shown to be fired at equally-spaced intervals, associated with points 41 to 46 on flight path 34. The duration of the intervals is commanded by the command signal and depends upon the angular orientation and rotational rate of weapon 16, as weII as error veotor $\bar{e}$, when weapon 16 receives the command signal from weapon control system 11.

FIG. 9 depicts forces $T_1$ and $T_8$ resulting from the firing of two of the thrusters located on the periphery of weapon 16. The forces acting on weapon 16 as a result of the thrusters produce a rapid acceleration of weapon 16 so as to create velocity $V_c$ in the direction of target 21.

4. Weapon Configuration

Figure 10:
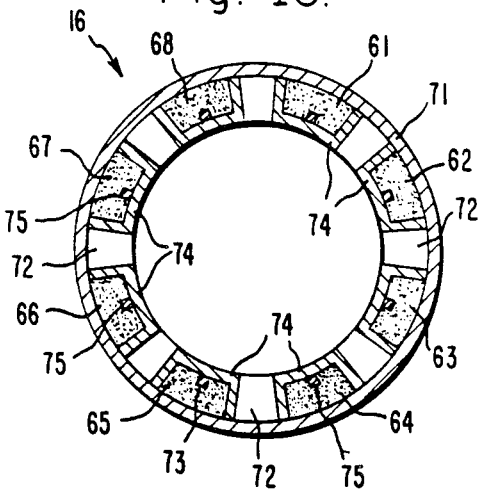
FIG. 10 is a cross-sectional view of the weapon depicting the manner in whch the thrusters are mounted on the periphery of the weapon.

FIG. 10, a cross-sectional view of weapon 16, depicts the manner in which thrusters 61 to 68 are mounted on the periphery of weapon 16. Elaborating further, typical thruster 66 is shown comprising a frame 72 which encompasses turning charge 73 and an explosive detonator 75; preformed inert assembly 74 is placed adjacent to the thrusters, in effect isolating one thruster from its adjacent thruster. Shell casing 71 of weapon 16 is also shown in FIG. 10.

5. Terminal Guidance Technique of Weapon

The weapon guidance technique of the invention, whereby the angular orientation of weapon 16 is determined, is explained with reference to FIGS. 6, 7, 8 and 9.

5(a) Weapon Canted Antenna Configuration

As shown in FIG. 9, weapon 16 has polarized antenna 25 at the rear of and located in reference to weapon 16 longitudinal axis 60 of weapon 16. The plane of antenna 25 is canted (that is, skewed or tilted) by an angle $\theta$, which is approximately 2 to 3 degrees, with respect to a plane perpendicular to longitudinal axis 60 of weapon 16, wherein orientation line 81 lies in said plane. A signal is transmitted by a relatively low-power (on the order of five milliwatts) transmitter beacon 24, which is carried by weapon 16, using linearly polarized antenna 25. The signal is sent to angle measurement device 13. A linearly polarized antenna associated with angle measurement device 13, which also contains a beacon receiver, senses the beacon signal. FIG. 6 pictorally illustrates the fields of polarization of the antenna associated with angle measurement device 13 and of antenna 25 associated with weapon 16. The vectors E and H of antenna field of polarization are indicated for the two antenna fields. The field of the antenna associated with angle measurement device 13 is indicated to be vertically polarized. Antenna 25 is indicated to have a spinning field since antenna 25 rotates as weapon 16 rotates in flight. While weapon 16 is in flight, antenna 25 field vectors E and H rotate at the spin rate (typically 100 r.p.s.) of weapon 16 relative to the respective field vectors E and H of antenna 25. The rotation of antenna 25 field vectors E and H relative to the antenna associated with angle measurement device 13 field vectors produces a modulation of the signal sent from weapon 16 to radar system 15.

5(b) Signal Modulation re: Antenna Configuration

Figure 7:
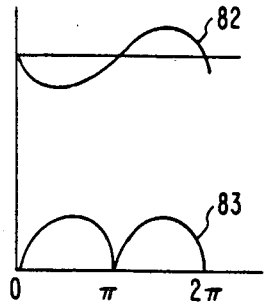
FIG. 7 depicts the envelope of the beacon signal sent from the weapon to the ground-based radar system.

The modulation of the beacon signal due to antenna polarization produces a signal which is depicted as waveform 83 in FIG. 7. Waveform 83 has oscillation period $\pi$, because each time the E field vector of antenna 25 is aligned with the H field vector of the antenna associated with radar system 15, a signal null is created which is illustrated by curve 83. Curve 83 demonstrates that nulls occur twice per spin cycle of weapon 16. Since the spin cycle of weapon 16, while weapon 16 is in flight and rotating (at a typical rate of 100 r.p.s.) is $2\pi$, as depicted by waveform 82, the modulation characteristics of signal curve 83 is phase-angle ambiguous insofar as defining the angular orientation of weapon 16, because any particular point on the surface of weapon 16 could be out of phase by $\pi$.

Weapon 16 angular rotation and angular rotational rate telemetry information, which is required for correctly commanding the firing sequence of the thrusters located on the periphery of weapon 16, is provided by canting linearly polarized antenna 25 with respect to a plane perpendicular to the longitudinal axis 60 of weapon 16, so that the signal sent from the beacon transmitter on weapon 16 rotates with signal cross-over at the antenna gain 3 dB point as weapon 16 rotates. FIG. 8 illustrates a typical signal return indicating waveform 85 characteristics for the E field vector of antenna 25 rotated by 90 degrees with respect to antenna weapon orientation line 81 (as depicted in FIG. 6). Waveform 85 indicates that the beacon transmitted signal on weapon 16 has modulation envelope with a wide null and a narrow null, wherein the modulation envelope is produced by the canting of linearly polarized antenna 25 with respect to a plane perpendicular to the longitudinal axis 60 of weapon 16 and having the E field vector of antenna 25 rotated by 90 degrees with respect to antenna weapon orientation line 81. From the modulation envelope of waveform 85, the rotational ambiguity of weapon 16 described supra, can be resolved with use of the wide null and narrow null characteristics. Each time the weapon, has gone through a full rotation of $2\pi$, only one narrow and one wide signal null is produced.

Consequently, the signal received by radar system 15 from antenna 25 of weapon 16 is modulated by two effects: (1) the polarity modulation caused by the beacon signal E vector spinning with respect to the stationary receiving antenna's E vector of angle measurement device 13; and (2) the nutating amplitude modulation resulting from weapon 16 rear-facing antenna which is pointed along the ballistic path of weapon 16. As shown by FIG. 7, the envelope signal, indicated by waveform 83, received by the polarized antenna of measurement device 13 from weapon 16 would have equally spaced nulls and peaks and it therefore would not be possible to determine the exact angular orientation of weapon 16. The canting of antenna 25 on weapon 16 induces a modulation in the signal transmitted from antenna 25 to measurment device 13, as depicted in FIG. 8 by waveform 85, so that the precise angular orientation of weapon 16 is known. Canting antenna 25 has no impact on the antenna of measurement device 13 until longitudinal axis 60 of weapon 16 is displaced from the line-of-sight of weapon 16 to radar system 15, as gravity changes the position of antenna 25 causing a change in the character of the signal, as depicted in FIG. 8, which will allow the determination of the geometric relationship of the ambiguous signal nulls that occur as weapon 16 rotates. In so removing the "up-down" ambiguity of weapon 16, while the weapon is in flight, the roll angle orientation and angular roll rate of weapon 16 are determined. The signal transmitted from weapon 16 also can be used to control the relative frequency of the local oscillator (LO) for command link 19. Consequently, data interface 54 command link RF frequency will be offset from this LO reference. It is necessary to determine the roll angle orientation of weapon 16 in order to command the terminal phase maneuver of weapon 16, since the turning capability of weapon 16 occurs in a single plane.

6. Alternate Implementations

To those skilled in the art, it should be apparent that the implementation of the above-described embodiment could be varied without departing from the scope of the invention. In all cases, it is understood that the above-described embodiments are merely illustrative of but a small number of the many possible specific embodiments which represent the application of the principles of the present invention. Furthermore, numerous and varied other arrangements can be readily devised in accordance with the principles of the present invention by those skilled in the art without departing from the spirit and scope of the invention.

We claim:

1. A weapon system for providing terminal guidance to a projectile which rotates about its longitudinal axis during flight and which responds to a command signal so as to modify the flight path in such a manner as to decrease the magnitude of the miss vector between the projectile and a target, said weapon system comprising:

means for tracking the target and providing tracking signals indicative of the location of the target;

means for lauching said projectile;

means for computing the location of said projectile after launch and for providing trajectory signals indicative of the trajectory of said projectile;

a canted linearly polarized antenna and a transmitter beacon both carried by said projectile such that transmitter beacon energy is transmitted from said antenna, whereby said energy is polarization modulated as a function of the angular orientation of said projectile;

means, responsive to the polarization modulated transmitter beacon energy, for measuring the relative angular orientation of said projectile about said axis; and means responsive to said tracking signals, said trajectory signals and to the measured angular orientation of said projectile for computing an uncorrected miss vector and for providing a command signal, during the terminal phase of flight of said projectile, so as to cause a decrease in the magnitude of the miss vector.

* * * * *